US005459874A

United States Patent [19]

Meredith

[11] Patent Number: 5,459,874

[45] Date of Patent: Oct. 24, 1995

[54] CONSTRUCTION OF FLOTATION SWIMSUITS

[75] Inventor: Jerry R. Meredith, Knoxville, Tenn.

[73] Assignees: Patti Gilmer; Nancy Packard; Pam Thomas; Rodney Robinson, all of Gainesville, Ga.

[21] Appl. No.: 31,270

[22] Filed: Mar. 15, 1993

Related U.S. Application Data

[63] Continuation-in-part of Ser. No. 317,344, Mar. 19, 1989, abandonedDes. 333,903.

[51] Int. Cl.[6] ..... A41D 7/00

[52] U.S. Cl. ..... 2/67; 2/2; 2/247; 2/243.1; 441/102; 441/106; 441/108; 441/112; 441/114; 441/115; 441/116

[58] Field of Search ..... 2/2, 2.15, 2.5, 2/46, 69, 69.5, 67, 247, 248, 249, 250, 251, 267, 268, 243.1, DIG. 3; 441/102, 106, 108, 109, 110, 111, 112, 113, 114, 115, 116, 117, 118, 119

[56] References Cited

U.S. PATENT DOCUMENTS

| | | | |
|---|---|---|---|
| D. 155,877 | 11/1949 | de Crenza . | |
| D. 157,646 | 3/1950 | Vaden . | |
| D. 245,881 | 9/1977 | Siddons . | |
| D. 285,622 | 9/1986 | Greene . | |
| D. 293,960 | 2/1988 | Berenson . | |
| 916,731 | 3/1909 | Liliedahl . | |
| 1,262,458 | 4/1918 | Crowell . | |
| 1,313,936 | 8/1919 | Bailey | 441/112 |
| 1,339,617 | 5/1920 | Deneau . | |
| 1,575,255 | 3/1926 | Czyzykowski . | |
| 1,730,812 | 10/1929 | Ford . | |
| 1,813,965 | 7/1931 | Sferrazza . | |
| 1,957,102 | 5/1934 | Earnshaw | 2/67 |
| 2,081,687 | 5/1937 | Temchin et al. . | |
| 2,331,301 | 10/1943 | Brown | 441/111 |
| 2,412,502 | 12/1946 | Garrison | 2/67 |
| 2,521,205 | 9/1950 | David . | |
| 2,569,742 | 10/1951 | Austin . | |
| 2,775,776 | 1/1957 | Shaw . | |
| 3,098,248 | 7/1963 | Geier . | |
| 4,193,153 | 3/1980 | Tyrer et al. . | |
| 4,291,427 | 9/1981 | Rhea . | |
| 4,380,441 | 4/1983 | Harr . | |
| 4,555,234 | 11/1985 | Kent | 441/106 |
| 4,619,622 | 10/1986 | McDonald . | |
| 5,033,986 | 7/1991 | Feigenbaum et al. | 2/67 X |

FOREIGN PATENT DOCUMENTS

| | | | |
|---|---|---|---|
| 16506/28 | 9/1929 | Australia . | |
| 122053 | 3/1931 | Austria . | |
| 992764 | 5/1965 | United Kingdom | 2/67 |
| 2036654 | 7/1980 | United Kingdom | 441/110 |

OTHER PUBLICATIONS

"Childcraft" , Spring–Summer 1986 Catalog, p. 37, Swim Trainer.

*Primary Examiner*—Jeanette E. Chapman
*Attorney, Agent, or Firm*—Deveau, Colton & Marquis

[57] ABSTRACT

Two embodiments of swimsuits providing flotation for the wearer of the suits are disclosed, in addition to methods of constructing such suits and a specialized tool facilitating the construction of such suits. The suits include a series of lower flotation pads located approximately adjacent the center of mass of the wearer, which pads provide the majority of buoyancy for the suit and its wearer. Upper flotation pads are located at the upper back and chest areas, to keep the body of the wearer of the suit upright in the water and preclude the lengthy immersion of the wearer's head or breathing passages. Both a generic suit and a suit tailored primarily for boys and men are disclosed. Methods of construction for the two suits are disclosed, in which specific steps preclude the need for time consuming and laborious hand sewing operations. A specialized tool is also disclosed, which tool facilitates the insertion of the foam pads into the pockets of the suits.

16 Claims, 6 Drawing Sheets

CONSTRUCTION OF FLOTATION SWIMSUITS

REFERENCE TO RELATED APPLICATION

This application is a continuation-in-part of applicant's U.S. Design Patent application Ser. No. 07/317,344, now U.S. Design Patent D-333,903 issued on Mar. 16, 1993.

FIELD OF THE INVENTION

The present invention relates generally to articles of apparel for water sports and the like, and more specifically to swimsuits providing flotation for the wearer and specific means of construction of such swimsuits.

BACKGROUND OF THE INVENTION

Swimming is a popular form of exercise and activity, which many persons enjoy. Other water sports, such as diving, water polo, etc. are also popular variations. Obviously, however, it is necessary that persons engaging in any form of water sports learn how to swim properly, or be provided with flotation. While many sports may be enjoyed by participants not expert in the sport, water sports generally require that a participant have at least some swimming skill or be provided with flotation. To engage in water sports without at least one of the above may prove hazardous to say the least. Even in the case of an expert swimmer, disaster may occur if the swimmer is rendered unconscious, as might happen if the swimmer strikes the bottom in a dive or for some other reason.

Accordingly, various swimsuits which provide flotation for the wearer have been developed. However, in each case they suffer from some deficiency, such as a requirement that an inflatable volume be inflated, or a lack of upper body flotation to keep the wearer's breathing passages out of the water. One of the reasons for these deficiencies is the difficulty of constructing a suit which provides proper flotation.

The need arises for a flotation swimsuit construction which provides adequate buoyancy for the upper body, in order to keep the breathing passages of the wearer clear of the water. The suit construction must provide for ease of construction in order to allow relatively rapid assembly by persons of average skill, in order to eliminate the need for costly specialized equipment and specialized hand labor. Accordingly, the method of construction must encompass a specific series of steps in order to allow the use of standard sewing machines, equipment and assembly by persons of average skill, in order to provide efficient construction at a relatively low expense. A specialized tool providing for the insertion of the flotation pads within pockets in the suit is also needed, to further provide rapid and efficient construction.

DESCRIPTION OF THE PRIOR ART

A patentability search was conducted relating to applicant's earlier design patent application. The following patents were uncovered in the course of that search:

U.S. Pat. No. 1,262,458 issued to Clarence E. Crowell on Apr. 9, 1918 discloses a Life Saving Skirt to be worn at the waist of a swimmer. The device is gathered and pleated when uninflated, and is raised immediately beneath the arms and inflated to form a tube when in use.

U.S. Pat. No. 1,339,617 issued to William M. Deneau on May 11, 1920 discloses a Life Preserver comprising a double walled swimsuit defining an inflatable chamber or chambers therebetween. The suit must be inflated for use as a flotation device.

U.S. Pat. No. 1,575,255 issued to Julian Czyzykowski on Mar. 2, 1926 discloses a Swimming Garment comprising a multiple compartmented inflatable device secured to the upper or chest portion of a swim suit. The device must be inflated for use.

U.S. Pat. No. 1,730,812 issued to James O. Ford on Oct. 8, 1929 discloses a Bathing Suit having a plurality of internal pockets providing for the containment of inflatable pads. Each of the pads must be individually inflated.

U.S. Pat. No. 1,813,965 issued to Giuseppe Sferrazza on Jul. 14, 1931 discloses a Life Saving Suit including a foldable and inflatable portion which extends from the back of the suit past the feet of the wearer when inflated. Additional features are disclosed which are unrelated to the present invention.

U.S. Pat. No. 2,081,687 issued to Yetta Temchin et al. on May 25, 1937 discloses an Inflatable Swimming Suit comprising trunks with shoulder straps, the shoulder straps providing attachment for inflatable devices similar to "water wings."

U.S. Pat. No. 2,521,205 issued to Malham H. David on Sep. 5, 1950 discloses a Life Preserver Attachment For Two Piece Swim Suits. The device is a generally U-shaped collar which may be fastened to the forward sides of a vest portion of a swimsuit, passing around the back of the neck and extending downward to the trunks. The collar must be inflated for use.

U.S. Pat. No. 2,569,742 issued to Charles H. Austin on Oct. 2, 1951 discloses a Safety Bathing Jacket to be worn over an existing swimsuit. The device contains a plurality of horizontal tubes, which tubes are filled with a buoyant substance such as cork.

U.S. Pat. No. 2,775,776 issued to Mark Shaw on Jan. 1, 1957 discloses a Buoyant Garment which embodiments include pockets for the carriage of pads of buoyant fibrous material (e.g., wool, kapok, etc.) The pads are enclosed in a waterproof material.

U.S. Pat. No. 3,098,248 issued to Adam Geier on Jul. 23, 1963 discloses Bathing Drawers including a series of inflatable tubes. The tubes may extend partially up the torso of the wearer when inflated.

U.S. Pat. No. 4,193,153 issued to Andrew C. R. Tyrer et al. on Mar. 18, 1980 discloses a Life Jacket formed of closed cell foam material. The article is worn over existing apparel rather than being integrated with a swimsuit or other article.

U.S. Pat. No. 4,291,427 issued to Richard L. Rhea on Sep. 29, 1981 discloses a Floatation Garment comprising one or more pads of buoyant material with lines of reduced thickness. The fabric inner and outer panels are sewn together along these reduced thickness lines. No provision is made for clearance of the sewing machine foot from the relatively thick buoyant material during construction, as does the present invention.

U.S. Pat. No. 4,380,441 issued to Robert G. Harr et al. on Apr. 19, 1983 discloses a Flotation Vest formed of four pieces of buoyant sheet material cut from a single rectangular sheet. The device provides for a minimum of waste material. The vest is worn over other apparel or swim wear, rather than as the swimsuit itself.

U.S. Pat. No. 4,619,622 issued to Edith N. McDonald et al. on Oct. 28, 1986 discloses a Swim Safe Play Suit including a plurality of closely spaced parallel tubes, the tubes either inflatable or containing a buoyant material. One embodiment provides for the tubes to be separate from the remainder of the suit so they may be rolled downwardly about the waist.

In addition to the above, the following patents were uncovered by the Examiner in the course of the examination of the above referenced parent design patent application:

U.S. Pat. No. 916,731 issued to Frank E. Liliedahl on Mar. 30, 1909 discloses a Bathing Suit which includes a vest, trunks, and a modesty panel or apron. No flotation is disclosed.

U.S. Pat. No. D-155,877 issued to Leo W. deCrenza on Nov. 8, 1949 discloses a Safety Swim Suit having a skirt with an inflatable periphery.

U.S. Pat. No. D-157,646 issued to Amy S. Vaden on Mar. 7, 1950 discloses Panties including lace leg openings. These were cited as being similar to the appearance of the ruffles provided in applicant's earlier design patent application noted above.

U.S. Pat. No. D-245,881 issued to Ronald D. Siddons on Sep. 27, 1977 discloses a Combined Swimming Suit And Inflatable Collar. It appears that inflation tubes are provided, and the flotation areas appear to be located on the stomach and chest areas and in the collar.

U.S. Pat. No. D-285,622 issued to Lynne Greene on Sep. 16, 1986 discloses Lady's Lingerie Or Similar Article. While the appearance is related to applicant's earlier design application, no flotation or function as a swimsuit is disclosed.

U.S. Pat. No. D-293,960 issued to Steven M. Berenson on Feb. 2, 1988 discloses a Buoyant Swim Suit apparently having two flotation areas, one on the back and one on the stomach, immediately above the waist.

Australian Patent No. 16,506/28 issued to James McRorie on Sep. 10, 1929 discloses an Improved Bathing And Surfing Costume including front and rear modesty panels which are secured to prevent displacement. No flotation means is disclosed.

Austrian Patent No. 122,053 issued to Morris W. Browdy on Mar. 25, 1931 discloses a "Badeanzug" (Bathing Suit) including an inflatable volume underlying the upper chest portion of the suit.

Finally, applicant is aware of the reference cited in the Office Action of Oct. 16, 1990 relating to his above noted design patent application. That reference is the Swim Trainer shown in the Childcraft Spring-Summer 1986 catalog on page 37. The device includes a single row of buoyancy pads located near the waist.

None of the above noted patents, taken either singly or in combination, are seen to disclose the specific arrangement of concepts disclosed by the present invention, particularly relating to the specific construction of a flotation swimsuit having the specific arrangement of flotation means disclosed herein and the advantages thereby provided.

SUMMARY OF THE INVENTION

By the present invention, an improved construction for flotation swimsuits is disclosed.

Accordingly, one of the objects of the present invention is to provide a method of construction for a flotation swimsuit, which method allows the construction of the suit using standard sewing machines and equipment and labor of average skill.

Another of the objects of the present invention is to provide methods of construction for a flotation swimsuit which are adaptable to suits for boys and girls, and are also adaptable to suits for adult men and women.

Yet another of the objects of the present invention is to provide flotation swimsuits constructed according to the methods disclosed herein, which include suits for boys, girls, men, and women.

Still another of the objects of the present invention is to provide flotation swimsuits which include flotation means capable of keeping the head of the wearer upright and the breathing passages of the wearer out of the water when the wearer of the suit is immersed.

Another object of the present invention is to provide flotation swimsuits which include a primary buoyancy area near the center of mass of the wearer's body and possessing the majority of flotation in the suit, and a secondary buoyancy area near the upper back and chest of the wearer in order to keep the head of the wearer upright when the wearer of the suit is immersed.

A further object of the present invention is to provide flotation swimsuits which are simple and economical to manufacture according to the methods of construction disclosed.

An additional object of the present invention is to provide a specialized tool for the insertion of the foam flotation pads into the pockets of the suits, thus further providing for ease of construction of the suits.

With these and other objects in view which will more readily appear as the nature of the invention is better understood, the invention consists in the novel combination and arrangement of parts and method steps hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
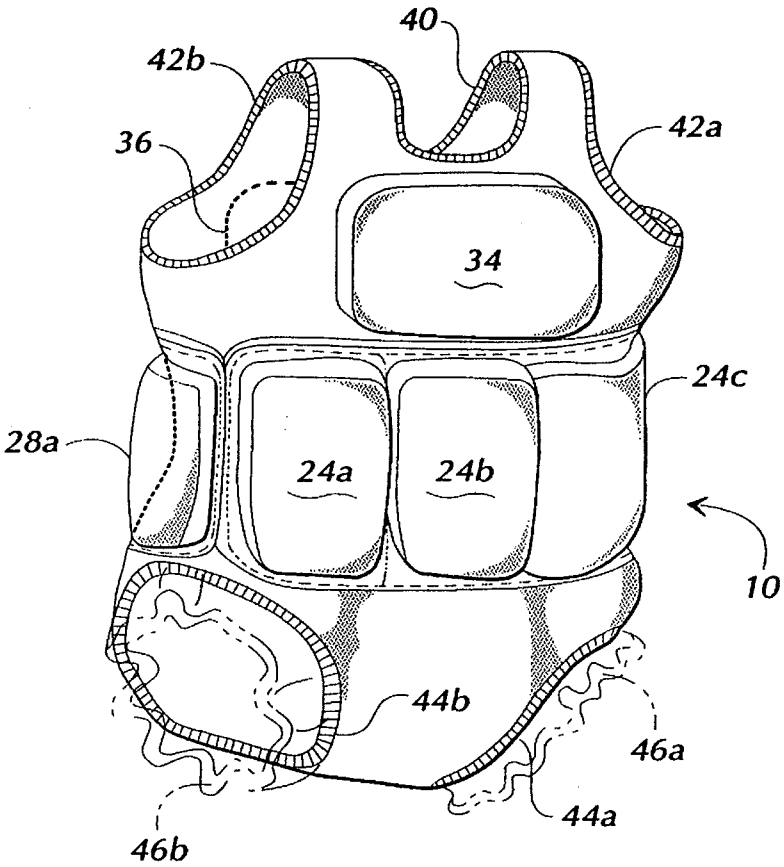
FIG. 1 is a perspective view of a generic flotation swimsuit constructed according to the present invention.

Referring now to the drawings, the present invention will be seen to relate to the construction of swimsuits providing proper flotation for the wearer thereof and maintaining the head of the wearer of the suit clear of the water when the wearer is immersed, and, further, a specific means of construction for such suits. FIG. 1 discloses a perspective view of one embodiment of a flotation suit of the present invention, showing a generic suit 10 and the flotation means provided therewith. While the suit 10 of FIG. 1 discloses an optional ruffled leg trim, it will be understood that such trim may be deleted to provide for a vested "unisex" or generic suit 10 which may be worn by children or adults of either sex.

Figure 2:
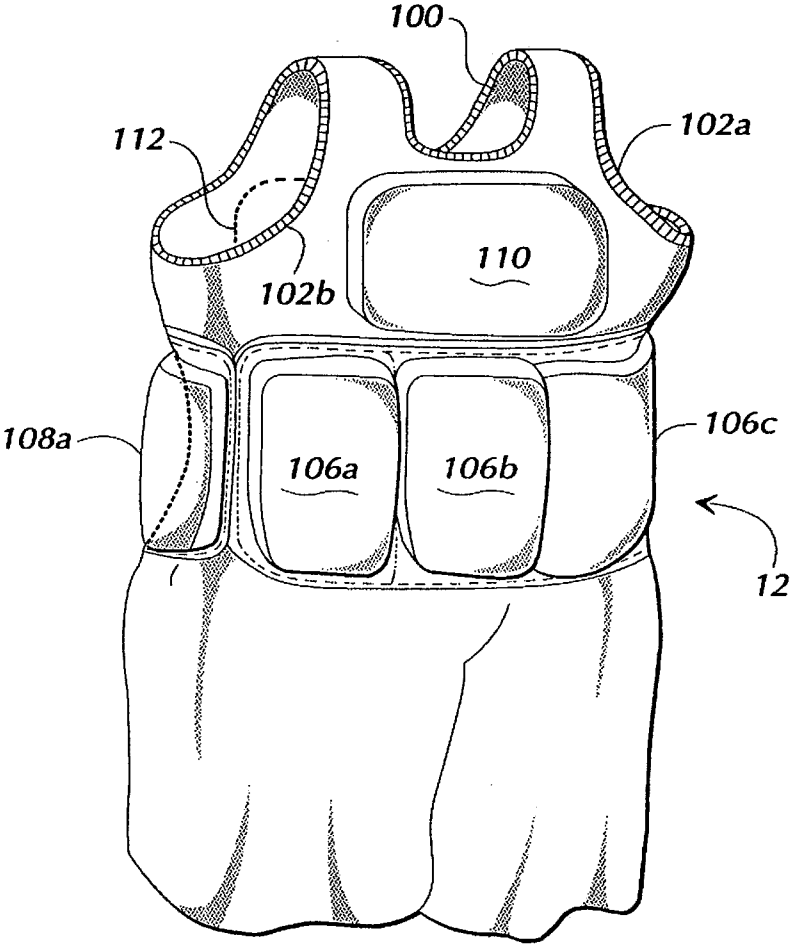
FIG. 2 is a perspective view of a flotation swimsuit for boys or men, constructed according to the present invention.

FIG. 2 discloses a boy's or men's style flotation suit also including flotation means. While the apparent difference is in the provision of short leg components in the suit 12 of FIG. 2, it will be evident that there are further differences in construction between the generic suit 10 of FIG. 1 and the boy's or men's style suit 12 of FIG. 2, due to the cut of the legs of suit 12. The primary area in common between the two suits 10 and 12 is the specific construction, installation, and location of the flotation means provided in suits 12, 10 and 12, and the stretchable synthetic spandex type fabric material from which the suits 10 and 12 are preferably made. The flotation pads are also formed of like material (preferably, a U.S. Coast Guard approved closed cell buoyancy foam material, such as the T-200 grade manufactured by the Voltek Corporation) for the two suits 10 and 12. While other materials may be substituted for the above fabric and foam, it has been found that the preferable materials described above are optimum for the present invention.

As noted in the paragraph above, the specific location of the foam flotation pads is essentially identical in suits 10 and 12. This specific location provides advantages over other flotation suits known, in that the suits 10 and 12 of the present invention provide sufficient flotation high upon the body of the wearer(s) of the suit(s) to preclude immersion of the breathing passages of the wearer(s) while in the water. The center of mass of the human body lies at the approximate location of the navel, or approximately at the waist or slightly above. While many flotation suits and devices have been constructed which provide flotation means at approximately waist level for the wearer, the problem is that flotation means solely at the waist of the wearer does nothing to assure that the upper body will remain above water. Many tragedies have occurred in which the body of the wearer of a flotation device has been kept afloat, only to allow the body to invert so the breathing passages of the wearer were under water.

While life vests and the like provide flotation above the center of mass of the wearer's body, the resulting garment is extremely bulky due to the lack of distribution of flotation means to other areas. Conversely, the swimsuits of the present invention provide the majority of flotation at or about the waist of the wearer, while providing further flotation for the upper body at the chest and back. Thus, the upper flotation need not be excessively bulky, as the majority of flotation is provided lower on the suit. Yet, the wearer's head is kept safely out of the water due to the flotation provided for the upper body by the suits of the present invention.

Figure 3:
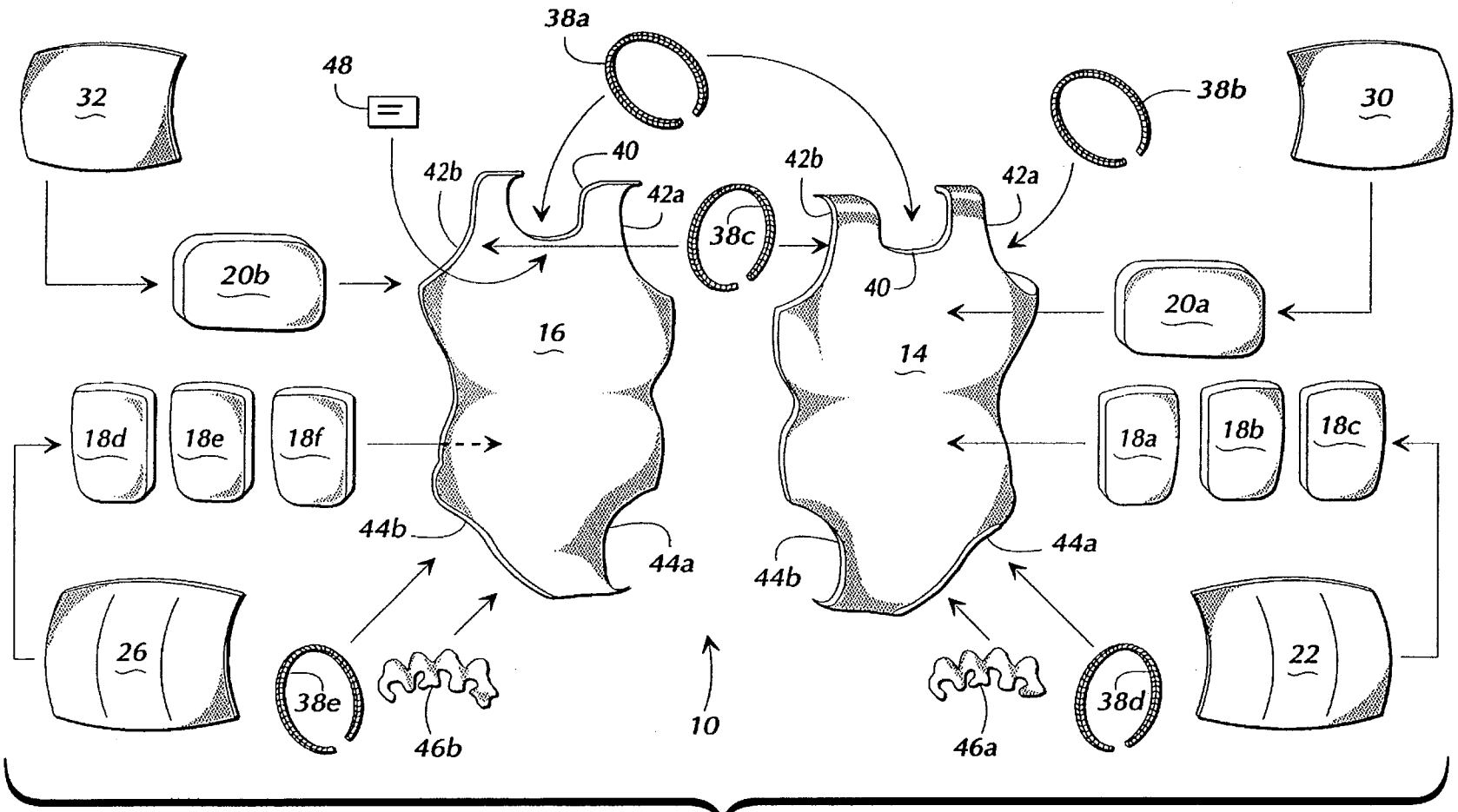
FIG. 3 is an exploded perspective view of the generic suit of FIG. 1, showing the basic components.

The construction of the generic suit 10 is best disclosed in FIG. 3 of the drawings. Suit 10 is basically constructed of a front panel 14 and mirror image back panel 16, with an upper and a lower level of closed cell foam material provided for flotation. (Panels 14 and 16, as well as pocket panels 22, 26, 30 and 32 discussed below and the equivalent parts of suit 12 of FIG. 2, are shown as having a definite thickness for greater clarity in the drawings, although it is understood that these components are of a thin fabric material.) The foam pads 18*a* through 18*f* of the lower level are all preferably equal in size (for a given size suit 10) and are secured around the waist of suit 10, pads 18*a* through 18*c* on the front panel 14 and pads 18*d* through 18*f* on the back panel 16 of suit 10. Two larger upper pads 20*a* and 20*b* are secured respectively to the chest area of front panel 14 and the back area of back panel 16. These pads 20*a* and 20*b* are each approximately 50% larger in volume than a single lower pad 18*a* through 18*f*. In other words, the two upper pads 20*a* and 20*b* will be seen to provide buoyancy approximately equal to half of the six lower flotation pads 18*a* through 18*f*.

Pads 18*a* through 18*c* on the front panel 14 of suit 10 are secured in place by means of a lower front pocket panel 22, which forms lower front pockets 24*a*, 24*b* and 24*c* respectively for foam pads 18*a*, 18*b* and 18*c* (see FIG. 1). A lower back pocket panel 26 serves to form lower back pockets 28*a* through 28*c* (pockets 28*b* and 28*c* are formed on the portion of the back panel 16 which is not visible in FIG. 1) respectively for pads 18*d* through 18*f*. Similarly, upper front and back flotation pads 20*a* and 20*b* are retained in place respectively by an upper front pocket panel 30 and an upper back pocket panel 32, which panels 30 and 32 respectively form an upper front pocket 34 and an upper back pocket 36, which pockets 34 and 36 are shown in FIG. 1.

In addition to the above basic components of generic suit 10, elastic material 38*a* through 38*e* may be installed respectively at the neck opening 40, left and right arm openings 42*a* and 42*b*, and left and right leg openings 44*a* and 44*b*. In the event a more feminine suit is desired, optional left and right ruffles 46*a* and 46*b* may be installed respectively at left and right leg openings 44*a* and 44*b*. Finally, a label 48 is included near the neck opening 40, if desired.

Figure 5:
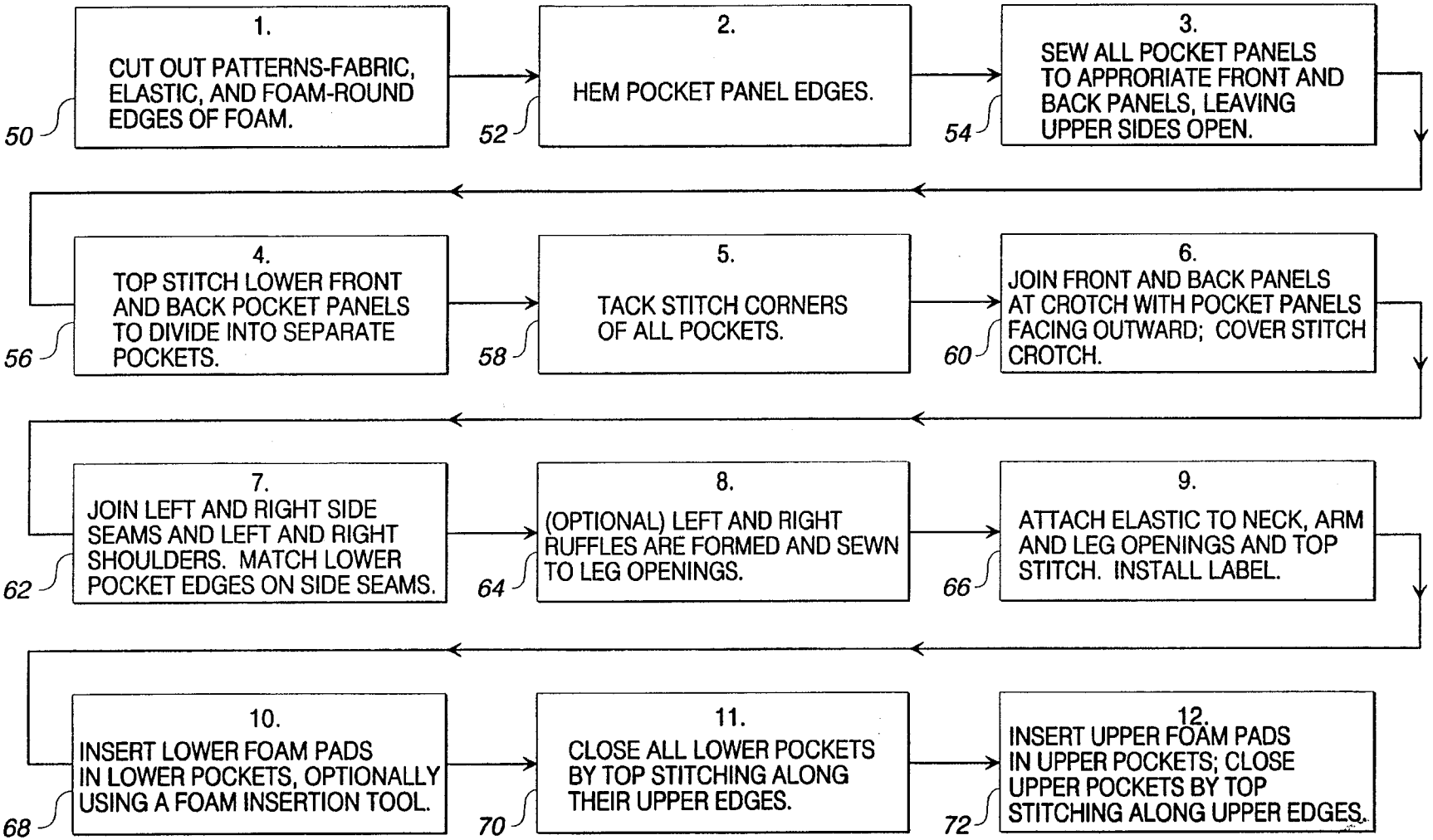
FIG. 5 is a block diagram showing the swimsuit for steps of construction of a generic flotation swimsuit, according to the present invention.

It is important to note that the specific order of assembly of the components of the above generic suit 10 is critical, in order to provide for the assembly of the entire suit 10 using a standard sewing machine. If a specific order is not followed, then at least some hand sewing will be required for assembly, which correspondingly requires a greater amount of time (and perhaps skill) than the exclusive use of a sewing machine, which would raise the cost of the suit 10 or 12 accordingly. The specific order of steps involved in the construction of the generic suit 10 of the present invention are as follows, and are shown in the flow chart of FIG. 5 as callouts 50 through 72 respectively for the following steps 1 through 12:

1. (Callout 50) All materials are cut for front and back panels 14 and 16, pocket panels 22, 26, 30 and 32, flotation pads 18*a* through 18*f*, 20*a* and 20*b*, elastic material 38*a* through 38*e*, and (optionally) ruffles 46*a* and 46*b*. Flotation pads 18*a* through 18*f*, 20*a* and 20*b* are also trimmed to round the outer edges and corners in order to preclude excessive wear to the edges and corners of their respective pockets 24*a* through 24*c*, 34, and 36.
2. (Callout 52) All pocket panels 22, 26, 28 and 30 are hemmed along the periphery of all four edges.
3. (Callout 54) Upper and lower front pocket panels 30 and 22 are sewn to front panel 14, and upper and lower back pocket panels 32 and 26 are sewn to back panel 16, preferably using a zigzag stitch in order to provide for the stretch inherent in the spandex material preferably used. Only the bottom and side edges of these pocket panels 22, 26, 30 and 32 are sewn at this time, leaving the upper edges open for the later insertion of the appropriate foam pads.
4. (Callout 56) After the various pocket panels have been secured to the front and back panels, the front and back lower pocket panels 22 and 26 are top stitched to divide them into three separate lower front pockets 24*a* through 24*c* and three separate lower back pockets 28*a* through 28*c*.

5. (Callout 58) All pocket corners are tack stitched for additional security.
6. (Callout 60) At this point, the front and back panels 14 and 16 are joined at the crotch, with the pocket panels facing outward. The crotch is cover stitched after joining.
7. (Callout 62) The left and right side seams and left and right shoulder seams of the front and back panels 14 and 16 are joined at this time. The lower pocket panel edges must be matched with the side seams for proper appearance.
8. (Callout 64) Optional left and right ruffles 46*a* and 46*b* may be formed and attached at this time, if desired. Ruffles 46*a* and 46*b* are formed by hemming and gathering their respective outer edges and stitching to the respective leg openings 44*a* and 44*b*.
9. (Callout 66) Elastic material 38*a* through 38*e* is then sewn to the edges respectively of neck opening 40, left and right arm openings 42*a* and 42*b*, and left and right leg openings 44*a* and 44*b*, preferably using a zigzag stitch. Neck opening 40, arm openings 42*a* and 42*b*, and leg openings 44*a* and 44*b* with their installed elastic are then top stitched. A label 48 may be installed with the top stitching operation on the neck opening 40, if desired.
10. (Callout 68) Lower foam flotation pads 18*a* through 18*f* are then installed within the top openings left respectively in pockets 24*a* through 24*c* and 28*a* through 28*c*. An optional foam installation tool, described further below, may be used to facilitate the operation.
11. (Callout 70) At this point, all lower pockets 24*a* through 24*c* and 28*a* through 28*c* can be closed by top stitching across their upper edges. A standard sewing machine may be used for this operation, since the needle foot and arm are not impaired by having the thickness of the upper foam pads in place as this operation is performed. While a free arm machine makes this step somewhat easier to perform, it is not essential as the stretchable nature of the preferred spandex fabric material permits the suit 10 to be maneuvered to allow the operation with a standard machine.
12. (Callout 72) The upper foam flotation pads 20*a* and 20*b* are then installed within their respective pockets 34 and 36, and the upper edges of pockets 34 and 36 are sewn closed in the manner described for the lower pockets 24*a* through 24*c* and 28*a* through 28*c*. As the sewing operation is adjacent the neck opening 40 and left and right arm openings 42*a* and 42*b* of suit 10, a standard sewing machine may again be used for this operation without hindrance.

A suit 10 constructed using the specific steps described above in the order presented, will be seen to permit construction using a standard sewing machine without need for special equipment or excessive amounts of highly skilled hand labor. The order of the above steps is critical to the success of the above procedure, in that any attempt to construct a suit 10 using a different order of the above steps, or different steps, will result in the construction sequence requiring laborious and time consuming hand stitching, some disassembly and reassembly, or some other setback at some point in the construction process.

Figure 4:
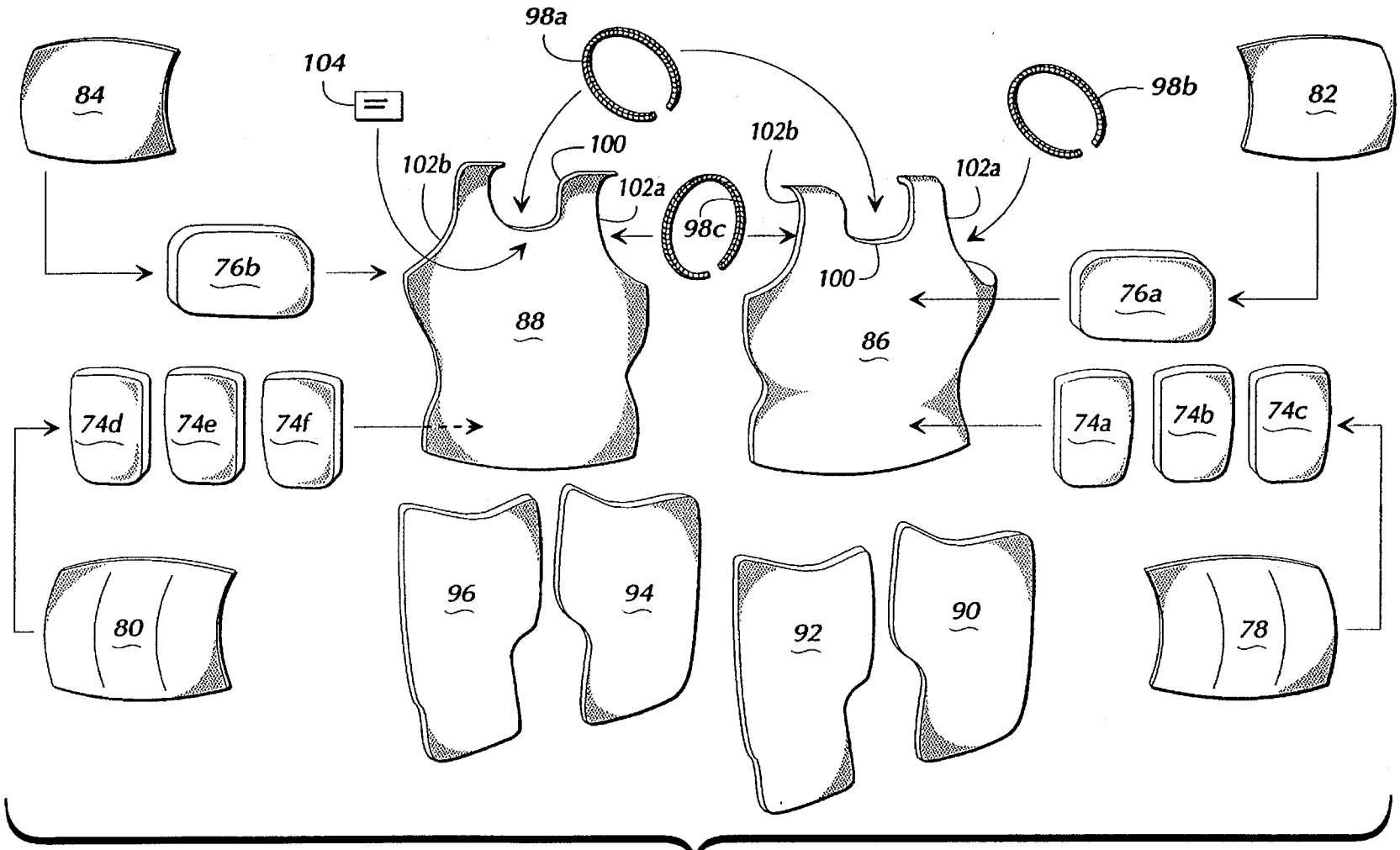
FIG. 4 is an exploded perspective view of the swimsuit for boys or men of FIG. 2, showing the basic components.

Thus far, the discussion of the present invention has related to a generic flotation swimsuit 10 and a specific method of construction thereof. While it has been noted that the above generic suit 10 may be worn by boys or men with the elimination of the more feminine ruffles 46*a* and 46*b* from the leg openings 44*a* and 44*b*, the boy's and men's flotation swimsuit 12 of FIGS. 2 and 4 may be more appropriate for most boys and men who require such a flotation suit. The male suit 12 will be seen to incorporate lower foam flotation pads 74*a* through 74*f* and upper flotation pads 76*a* and 76*b* as disclosed in FIG. 4, in the manner of flotation pads 18*a* through 18*f*, 20*a*, and 20*b* of generic suit 10. It will be noted that the lower front pocket panel 78, lower back pocket panel 80, upper front pocket panel 82, and upper back pocket panel 84 are essentially identical to the respective pocket panels 22, 26, 30 and 32 of generic suit 10.

However, in addition to the above flotation pads and pocket panels, male suit 12 comprises a total of six different suit panels as opposed to the two panels (front panel 14 and back panel 16) of generic suit 10. Male suit 12 includes an upper front panel 86 and upper back panel 88, which extend approximately from the waist upward in the manner of a vest when worn. In addition, the lower portion of men's suit 12 contains short leg portions, and as such the material must be cut in the manner of a pair of trousers in order to allow the proper fullness at the crotch and inseam areas. Accordingly, a separate lower portion of men's suit 12 is formed of a separate lower left front panel 90, lower right front panel 92, lower left back panel 94, and lower right back panel 96. Elastic members 98*a* through 98*c* are provided respectively for the neck opening 100 and left and right arm openings 102*a* and 102*b*, and a manufacturer's label 104 may be provided in the manner of the label 48 provided for generic suit 10.

Figure 6:
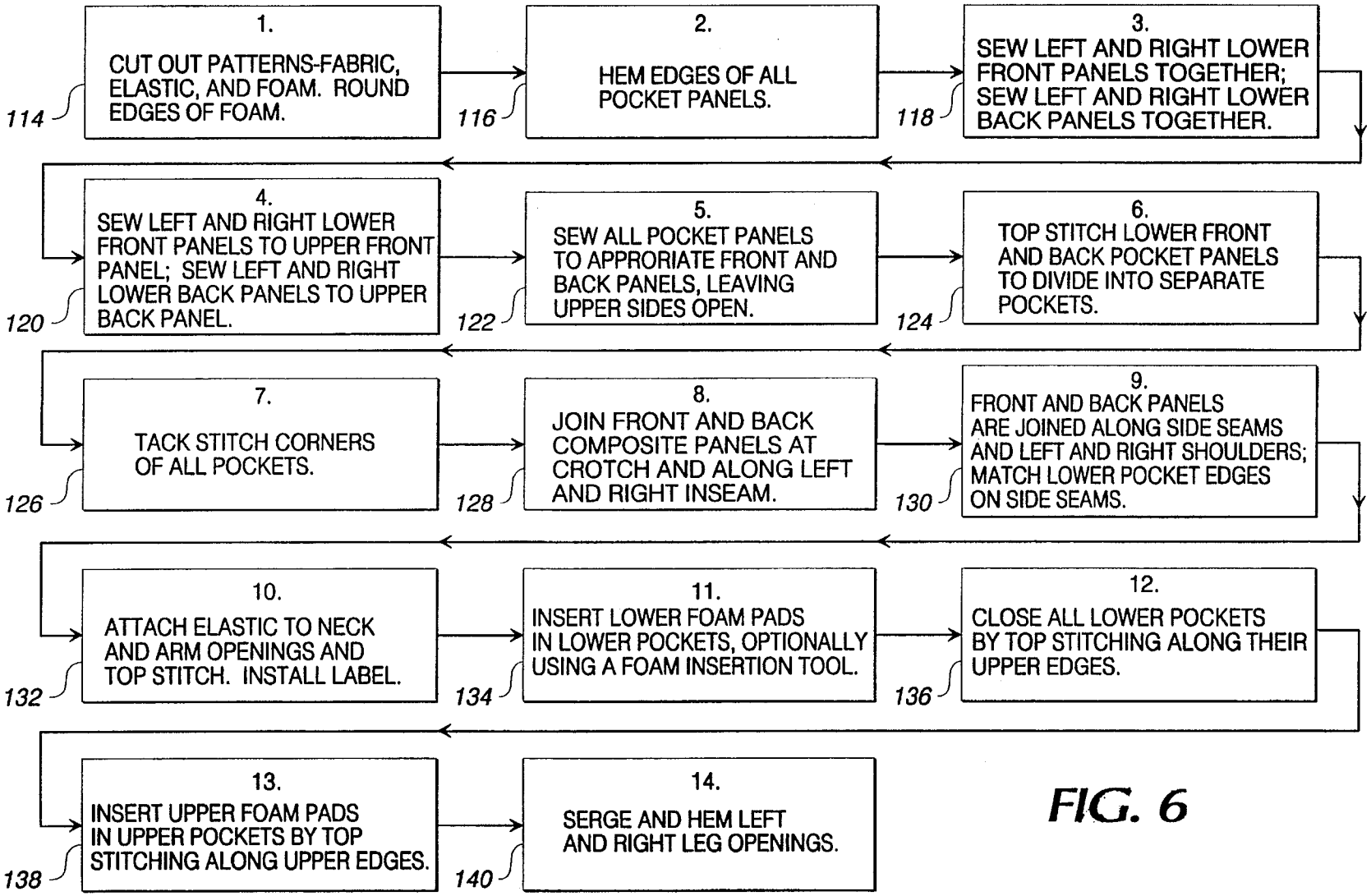
FIG. 6 is a block diagram showing the steps of construction of a flotation swimsuit for boys or men, according to the present invention.

While many of the steps of construction of men's suit 12 are substantially the same as those for generic suit 10, some differences will be noted due to the additional panels involved and sewing thus required. The criticality of the following steps is of the same order of importance as those steps discussed in the construction of generic suit 10 for the same reason, i.e. to provide for ease of construction using a standard sewing machine without the requirement for laborious and time consuming hand stitching or other labor intensive operations which might require specialized skills and/or equipment. The specific order of steps involved in the construction of the men's suit 12 of the present invention are as follows, and are shown in the flow chart of FIG. 6 as callouts 114 through 140 respectively for the following steps 1 through 14:

1. (Callout 114) All materials are cut for upper front and upper back panels 86 and 88, lower left and lower right front panels 90 and 92, lower left and lower right back panels 94 and 96, pocket panels 78, 80, 82, and 84, flotation pads 74*a* through 74*f*, 76*a* and 76*b*, and elastic material 98*a* through 98*c*. Flotation pads 74*a* through 74*f*, 76*a* and 76*b* are also trimmed to round the outer edges and corners in order to preclude excessive wear to the edges and corners of lower front pockets 106*a* through 106*c*, lower back pockets 108*a* through 108*c* (108*b* and 108*c* are not visible in FIG. 2), and upper front pocket 110 and upper back pocket 112.
2. (Callout 116) All pocket panels 78, 80, 82 and 84 are hemmed along the periphery of all four edges, as in the case of step 2 of the construction of generic suit 10.
3. (Callout 118) Left and right lower front panels 90 and 92 are sewn together, as are left and right lower back panels 94 and 96.

4. (Callout 120) Completed lower front panels 90 and 92 are sewn to upper front panel 86, and completed lower back panels 94 and 96 are sewn to upper back panel 88. At this point, a single front and single back panel will have been constructed, the panels being essentially equivalent to the panels 14 and 16 of generic suit 10. However, it will be noted that due to the cut of lower panels 90, 92, 94 and 96 to allow for fullness of the inseam and crotch area for the short leg construction, that the completed front and back panels of suit 12 will not lie flat. This is the reason for the need to form each front and back panel from three separate panels.

5. (Callout 122) Upper and lower front pocket panels 82 and 78 are sewn to the front panel comprising panels 86, 90 and 92, and upper and lower back pocket panels 84 and 80 are sewn to the back panel comprising panels 88, 94 and 96, preferably using a zigzag stitch in order to provide for the stretch inherent in the spandex material preferably used. Only the bottom and side edges of these pocket panels 78, 80, 82, and 84 are sewn at this time, leaving the upper edges open for the later insertion of the appropriate foam pads. As lower pocket panels 78 and 80 are located at the waist of suit 12 in the manner of lower pocket panels 22 and 26 of generic suit 10, it will be seen that these lower pocket panels 78 and 80 are sewn to the composite front and rear panels across the seams formed by joining the lower panel assemblies to their respective upper panels. A zigzag stitch is preferably used to allow for the stretch of the preferable spandex material.

6. (Callout 124) After the various pocket panels have been secured to the front and back panels, the front and back lower pocket panels 78 and 80 are top stitched to divide them into three separate lower front pockets 106*a* through 106*c* and three separate lower back pockets 108*a* through 108*c*, in the manner used for the formation of lower front and rear pockets 24*a* through 24*c* and 28*a* through 28*c* of generic suit 10.

7. (Callout 126) All pocket corners are tack stitched for additional security.

8. (Callout 128) At this point, the composite front and back panels formed respectively of individual front panels 86, 90 and 92, and individual back panels 88, 94 and 96, are joined at the crotch and along the left and right inseams with the pocket panels facing outward.

9. (Callout 130) The left and right side seams and left and right shoulder seams of the composite front and back panels are joined at this time. The lower pocket panel edges must be matched with the side seams, as in the case of the construction of generic suit 10.

10. (Callout 132) Elastic material 98*a* through 98*c* is then sewn to the edges respectively of neck opening 100 and left and right arm openings 102*a* and 102*b*, preferably using a zigzag stitch. Neck opening 100 and arm openings 102*a* and 102*b* with their installed elastic are then top stitched. A label 104 may be installed with the top stitching operation on the neck opening 100, if desired.

11. (Callout 134) Lower foam flotation pads 74*a* through 74*f* are then installed within the openings left respectively in the upper edges of pockets 106*a* through 106*c* and 108*a* through 108*c*. An optional foam installation tool, described further below, may be used to facilitate the operation.

12. (Callout 136) At this point, all lower pockets 106*a* through 106*c* and 108*a* through 108*c* can be closed by stitching across their upper edges in the manner used for the equivalent step in the construction of generic suit 10. A standard sewing machine may be used for this operation, since the needle foot and arm are not impaired by having the thickness of the upper foam pads in place as this operation is performed. While a free arm machine makes this step somewhat easier to perform, it is not essential as the stretchable nature of the preferred spandex fabric material permits the suit 12 to be maneuvered to allow the operation with a standard machine.

13. (Callout 138) The upper foam flotation pads 76*a* and 76*b* are then installed within their respective pockets 110 and 112, and the upper edges of those pockets 110 and 112 are sewn closed in the manner described for the lower pockets 106*a* through 106*c* and 108*a* through 108*c*. As the sewing operation is adjacent the neck opening 100 and left and right arm openings 102*a* and 102*b* of suit 12, a standard sewing machine may again be used for this operation without hindrance.

14. (Callout 140) At this point, only the lower ends of the left and right leg openings are left unfinished. These leg openings are finished with a serge operation and hemmed to appropriate length to complete boy's or men's suit 12.

As in the case of the construction of generic suit 10 described above, the order of the above steps for the construction of boy's or men's suit 12 is critical to the success of the above procedure, in that any attempt to construct a suit 12 using a different order of the above steps, or different steps, will result in the construction sequence requiring laborious and time consuming hand stitching, some disassembly and reassembly, or some other setback at some point in the construction process.

Figure 7:
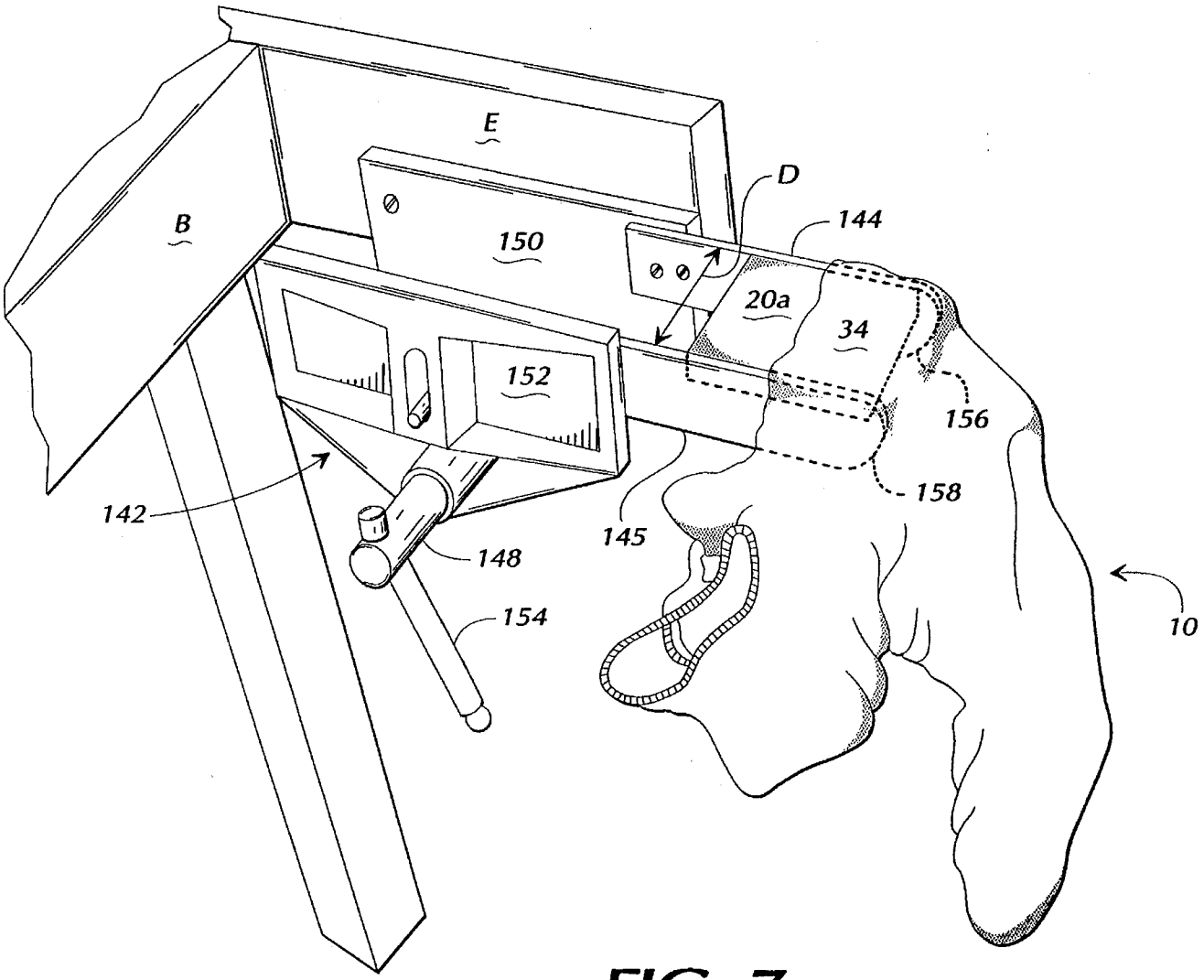
FIG. 7 is a perspective view of a tool providing for the insertion of foam flotation pads within pockets of the suits, showing the use thereof.

Mention was made above of a specialized tool providing for the insertion of the foam flotation pads within the pockets of suits 10 and 12 during their construction. This tool 142 is shown in FIG. 7 of the drawings. Foam insertion tool 142 comprises a first tine 144 and a parallel second tine 146 preferably having a variable distance D therebetween. The distance D may be adjusted by means of adjustment control 148, which may threadedly advance and withdraw from a fixed base plate 150 to which first tine 144 is attached, or advance and withdraw by some other means (e.g., cam or lever action, etc.) Second tine 146 is attached to a movable plate 152 which is advanced or withdrawn by means of adjustment control 148. A lever 154 may be used with adjustment control 148 in order to provide either mechanical advantage or finer adjustment of the distance D between first and second tines 144 and 146.

While the above foam insertion tool 142 may be roughly analogous to a vise or clamp, the elongate first and second tines 144 and 146 provide a holding or gripping action for articles removed from the fixed base plate 150 and movable plate 152, thus allowing an enclosure (e.g., a pocket 34 of a generic suit 10) to be passed thereover to surround any article (e.g., a foam flotation pad 20*a*) included between first and second tines 144 and 146. The respective distal ends 156 and 158 of first and second tines 144 and 146 are smoothly rounded in order to preclude snagging or catching upon any fabric material which may be passed thereover. Tool 142 is preferably mounted to a fixed structure, such as a workbench B or extension E thereof, in order to provide for ease of operation by the user.

Foam insertion tool 142 is used by widening the variable distance D as required for the placement of a foam flotation pad, such as pad 20*a* shown in FIG. 7, therein. Adjustment control 148 and lever 154 may then be used to advance the second tine 146 toward the first tine 144, to narrow the distance D to sandwich pad 20*a* between tines 144 and 146. Due to the elastomeric nature of the material used for the pads of the swimsuits of the present invention, distance D may be further narrowed in order to more firmly clamp pad 20*a* between tines 144 and 146. This provides two advantages: (1) the further narrowing of the distance D serves to provide firmer clamping force upon a pad included therebetween, thereby more firmly holding the pad in place, thus better precluding any slippage during the insertion process, and (2) the pocket of the suit into which the pad is to be inserted, may be more easily passed over the more closely spaced first and second tines 144 and 146 to facilitate and speed the operation.

The above foam insertion tool 142 will be seen to provide a much easier and faster means of inserting the various foam pads of the swimsuits 10 and 12 of the present invention, into their respective pockets. The alternative means using the hands is awkward at best, due to the extremely flaccid nature of the fabric and the need to hold the edges of the pocket apart constantly while at the same time advancing the foam pad into the pocket.

Accordingly, the above specification discloses two different embodiments for flotation swimsuits, each of which provide a majority of flotation means at or about the waist of the wearer, in addition to a lesser amount of upper flotation means at the chest and back of the wearer to preclude inversion of the wearer while in the water. The specific arrangement of flotation provided by suits 10 and 12 of the present invention preclude lengthy immersion of the head or breathing passages of a wearer of either suit while engaging in water sports or the like. Moreover, methods of construction for the suits of the present invention are disclosed, enabling the suits to be manufactured using standard sewing equipment and operators without requiring costly and/or labor intensive operations. Finally, a tool specifically providing for the insertion of the foam pads of the suits of the present invention is disclosed, which tool provides for the rapid and efficient construction and manufacture of the suits.

It is to be understood that the present invention is not limited to the sole embodiment described above, but encompasses any and all embodiments within the scope of the following claims.

I claim:

1. A method of construction for a flotation swimsuit, said method comprising the following steps:

(1) cutting out front and back panels, upper and lower pocket panels, elastic material, and foam flotation pads for the construction of the flotation swimsuit;

(2) after step (1), hemming upper and lower pocket panel edges;

(3) after step (2), sewing sides and bottom of the upper and lower pocket panels to the appropriate front and back panels and leaving upper sides of each of the pocket panels open, thereby forming upper and lower pockets;

(4) after step (3), sewing through the front and back lower pocket panels and respective front and back panels to divide the lower pocket panels into a plurality of separate pockets;

(5) after step (4), tack stitching each corner of each of the pockets;

(6) after step (5), joining the front and back panels at a crotch of the panels and cover stitching the crotch;

(7) after step (6), joining respective left and right sides and left and right shoulders of the front and back panels, and matching side edges of said lower pockets with respective side edges of the front and back panels;

(8) after step (7), inserting foam flotation pads within the lower pockets;

(9) after step (8), closing the lower pockets by top stitching along their upper sides, thereby enclosing the foam flotation pads therein;

(10) after step (9), inserting foam flotation pads within the upper pockets; and

(11) after step (10), closing the upper pockets by top stitching along their upper sides, thereby enclosing the foam flotation pads therein.

2. The method of claim 1 including:

joining the front and back panels at the crotch of the panels with the pockets of the panels facing outward.

3. The method of claim 1 including:

cutting out lower left and lower right front panels, lower left and lower right back panels, and upper front and back panels;

sewing the lower left front panel to the lower right front panel and the lower left back panel to the lower right back panel, thereby forming a lower front panel and a lower back panel; and sewing the lower front panel to the upper front panel and the lower back panel to the upper back panel, thereby forming a front and a back panel.

4. The method of claim 3 including:

joining the front and back panels at the crotch of the panels with the pockets of the panels facing outward.

5. The method according to claim 1 including:

attaching elastic material to a neck opening, left and right arm openings, and left and right leg openings and top stitching each of the openings.

6. The method according to claim 1 including:

cutting out ruffles;

gathering the ruffles; and sewing the ruffles to the leg openings.

7. The method according to claim 1 including:

installing a label inside of a neck opening.

8. The method according to claim 1 including:

providing a foam insertion tool; and inserting the foam flotation pads in the suit pockets by means of the foam insertion tool.

9. A method of construction for a flotation swimsuit, said method comprising the steps of:

cutting out front and back panels, upper and lower pocket panels, elastic material, and foam flotation pads for the construction of the flotation swimsuit;

hemming upper and lower pocket panel edges;

sewing sides and bottom of the upper and lower pocket panels to the appropriate front and back panels and leaving upper sides of each of the pocket panels open, thereby forming upper and lower pockets;

sewing through the front and back lower pocket panels and respective front and back panels to divide the lower pocket panels into a plurality of separate pockets;

tack stitching each corner of each of the pockets;

joining the front and back panels at a crotch of the panels and cover stitching the crotch;

joining respective left and right sides and left and right shoulders of the front and back panels, and matching side edges of said lower pockets with respective side edges of the front and back panels;

inserting foam flotation pads within the lower pockets by utilizing a foam pad insertion tool comprising means for gripping a foam flotation pad, passing, one at a time, the lower pockets of the flotation swimsuit over said means for gripping as it grips the foam flotation pad to install the flotation pad within the lower pocket, and withdrawing the lower pocket including the flotation pad from said means for gripping;

closing the lower pockets by top stitching along their upper edges, thereby enclosing the foam flotation pads therein;

inserting foam flotation pads within the upper pockets by utilizing said foam pad insertion tool; and closing the upper pockets by top stitching along their upper sides, thereby enclosing the foam flotation pads therein.

10. The method of claim 9 including:

joining the front and back panels at the crotch of the panels with the pockets of the panels facing outward.

11. The method of claim 9 including:

cutting out lower left and lower right front panels, lower left and lower right back panels, and upper front and upper back panels;

sewing the lower left front panel to the lower right front panel and the lower left back panel to the lower right back panel, thereby forming a lower front panel and a lower back panel; and sewing the lower front panel to the upper front panel and the lower back panel to the upper back panel, thereby forming a front and back panel.

12. The method of claim 9 including:

joining the front and back panels at the crotch of the panels with the pockets of the panels facing outward.

13. The method of claim 9 including:

attaching elastic material to a neck opening, left and right arm openings and left and right leg openings and top stitching each of the openings.

14. The method of claim 9 including:

cutting out ruffles; gathering the ruffles; and sewing the ruffles to the leg openings.

15. The method of claim 9 including:

installing a label inside of a neck opening.

16. The method of claim 9 wherein said foam insertion tool comprises a first fixed tine and a parallel movable second tine including a distance therebetween, and wherein said fixed first tine and said second tine correspond to said gripping means.

* * * * *